United States Patent [19]

Sando et al.

[11] 4,352,277

[45] Oct. 5, 1982

[54] APPARATUS FOR APPLYING A TREATING SOLUTION TO A CLOTH AS FOAMS CONTINUOUSLY

[75] Inventors: Yoshikazu Sando; Hiroshi Ishidoshiro; Eiichi Nakano, all of Wakayama, Japan

[73] Assignee: Sando Iron Works Co., Ltd., Wakayama, Japan

[21] Appl. No.: 207,778

[22] Filed: Nov. 17, 1980

[30] Foreign Application Priority Data

Nov. 21, 1979 [JP] Japan ..... 54-151085

[51] Int. Cl.[3] ..... D06B 3/10

[52] U.S. Cl. ..... 68/175; 68/19; 68/207; 118/122

[58] Field of Search ..... 68/19, 175, 178, 179, 68/181 R, 183, 207; 118/122, 427

[56] References Cited

U.S. PATENT DOCUMENTS 1,309,858 7/1919 Jones ..... 118/122 X
3,068,774 12/1962 Barston ..... 68/179 X
3,913,359 10/1975 Childers et al. ..... 68/175 X
4,193,762 3/1980 Namboodri ..... 68/175 X

*Primary Examiner*—Philip R. Coe
*Attorney, Agent, or Firm*—Toren, McGeady & Stanger

[57] ABSTRACT

An apparatus for continuously applying a treating solution as foam to a cloth, comprising a U-shaped foam tank for storing foam of a treating solution such as a dye solution supplied from an apparatus for generating foam of the treating solution, guide rolls for transporting a cloth to be treated continuously through the foam tank so as to adhere the foam of the treating solution to the cloth while the cloth is passing through the foam tank, and a means for controlling the amount of foam adhered to the cloth in taking out the cloth from the foam tank. By using this apparatus, a necessary and sufficient amount of the treating solution for the subsequent heat treatment of the cloth can be applied to the cloth uniformly with no need of removing the excess of treating solution and/or solvent from the cloth prior to the heat treatment.

3 Claims, 2 Drawing Figures

APPARATUS FOR APPLYING A TREATING SOLUTION TO A CLOTH AS FOAMS CONTINUOUSLY

BACKGROUND OF THE INVENTION

The present invention relates to an apparatus for applying a treating solution such as a dye solution to a cloth as foam continuously for the subsequent heat treatment of the resulting cloth.

Processing a textile product such as a cloth may roughly be classified into a pretreatment including scouring and bleaching, dyeing and finishing. In such processing operations, a treating solution containing a corresponding treating agent, such as caustic alkali and a bleaching agent in pretreatment, a dye in dyeing and a finishing agent in finishing, is applied to the cloth, and the cloth is then subjected to heat treatment. As a means for applying a necessary amount of a treating agent to a cloth in these processings, either a method of using a transfer paper or a method of soaking the cloth with a treating solution has usually been adopted. However, the method of applying a treating agent by using a transfer paper is limited of the use of an expensive agent, and a method of soaking a cloth with a treating solution has been widely adopted.

In applying a treating solution continuously to a long cloth by using the method of soaking a cloth with a treating solution, it needs usually an excess of the treating solution in order to adhere the treating agent to the cloth sufficiently and uniformly, so that the excess of the treating solution and/or solvent must be removed from the resulting cloth prior to the heat treatment. Intermediate drying is done usually for this purpose, but this method consumes a large quantity of heat energy. To diminish the consumption of heat energy, such a process as squeezing the solution and/or solvent has also been done in some instances with the use of a powerful mangle, but there is a limit for the amount of the solution and/or solvent squeezed out thereby and a sufficient amount of the solution and/or solvent can hardly be removed. When the treating solution is not applied in excess, the distribution of the treating agent in the cloth becomes non-uniform, and a satisfactory treatment of the cloth can by no means be attained.

SUMMARY OF THE INVENTION

Under such circumstances, the object of the present invention is to offer an apparatus for applying a treating solution to a cloth to be treated running continuously with which a necessary and sufficient amount of a treating solution for the subsequent heat treatment thereof can be applied to the cloth uniformly with no need of removing the excess of the treating solution and/or solvent from the resulting cloth.

The principle of the inventive apparatus is based on the use of a method of applying a treating solution to a cloth by utilizing it in the state, which comprises passing a cloth continuously through a foam tank of a treating solution fitted with a means for controlling the amount of foams adhered to the cloth in taking out the cloth out of the foam tank for applying a predetermined amount of a treating solution uniformly to the cloth.

Embodiments of the invention will be described in detail according to the drawings showing the examples of the inventive apparatus in the following.

Figure 1:
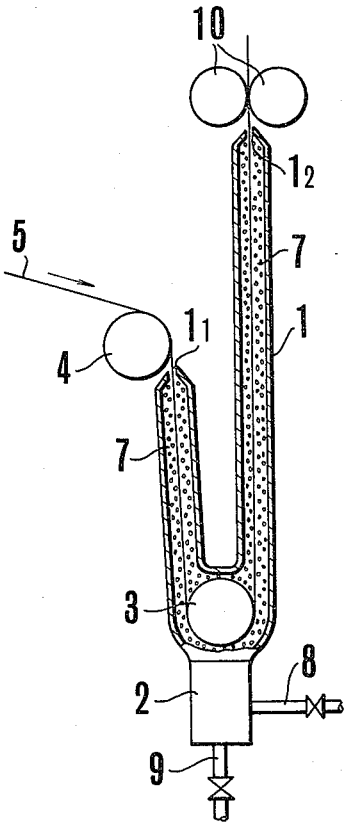
FIG. 1 is the sectional side view of an example of the present inventive apparatus.

In the drawings, 1 is a foam tank, $1_1$ is a cloth inlet, $1_2$ is a cloth outlet, 2 is an apparatus for generating foam, 3 is a cloth guide roll, 4 is also a cloth guide roll, 5 is a cloth to be treated, 6 is a pair of cover plates, 7 denotes foam of a treating solution, 8 is a treating solution supply tube, 9 is an air supply tube and 10 is a pair of press rolls.

DESCRIPTION OF THE PREFERRED EMBODIMENTS

In FIG. 1, 1 is a foam tank to store a treating solution, whose side walls are U-shaped forming a pair of upwardly extending legs joined together at the bottom of the side walls by a bight section. 2 is an apparatus for generating foam of a treating solution provided at the bight section in the bottom of the foam tank 1. The apparatus for generating foam, 2, is the one which can generate shaving cream-like fine foam, but the apparatus for generating foam itself is without the scope of the present invention, so that the explanation of the construction is omitted here.

Figure 2:
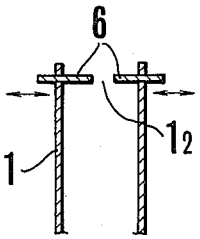
FIG. 2 illustrates the construction of another example of the cloth outlet from the foam tank in the apparatus in FIG. 1.

3 and 4 are cloth guide rolls respectively provided at the bottom of the foam tank 1 and in the vicinity of the cloth inlet $1_1$ at the upper end of the left hand leg, note FIG. 1, of the foam tank 1 mentioned below for transporting a long cloth 5 to be treated continuously through the foam tank 1. $1_1$ and $1_2$ are respectively a cloth inlet and a cloth outlet of the foam tank 1 each located at the upper end of a different one of the legs of the U-shaped tank, and their openings are narrowed so as to prevent the escape of the foam from the foam tank 1. The opening of the cloth outlet $1_2$ serves also for controlling the amount of foams adhered to the cloth. As shown in FIG. 2, the outlet $1_2$ comprises desirably a pair of cover plates 6, which can be slidable in the direction shown by the arrows in the figure, for controlling the amount of foam adhered to the cloth freely and more eminently.

7 denotes foam of the treating solution generated in the apparatus for generating foam, 2, and stored in the foam tank 1. The foam is generated by supplying a treating agent such as caustic soda or a dye dissolved in a solvent, usually water, together with a foaming agent such as soap or a surface active agent from a treating solution supply tube 8 and simultaneously by supplying air from an air supply tube 9, and the foam is stored in the foam tank 1. 10 is a pair of press rolls to press the cloth 5 adhering a predetermined amount of the foam for absorbing the treating solution in the cloth.

The continuous application of a treating solution to a cloth by using this apparatus is done, for example, as follows.

Foam 7 of a treating solution containing a pretreating agent, a dye or a finishing agent generated in the apparatus 2 for generating foam is filled in the foam tank 1 at the bottom and flows upwardly through the legs, and then a long cloth 5 to be treated, is introduced is passed continuously through the foam tank 1 down one leg and up the other by means of the cloth guide rolls 3 and 4. The foam of the treating solution 7 adheres to both sides of the cloth 5 while the cloth is passing through the foam tank 1, and the cloth adhering the foam is taken out from the cloth outlet $1_2$. The amount of foam adhered to the cloth is controlled by adjusting the width of the opening of the cloth outlet $1_2$. Particularly, when a pair of cover plates 6 in FIG. 2 are slidable on both sides, the width of the opening of the cloth outlet $1_2$ can be controlled freely. The cloth retaining a desired amount of foam is pressed with a pair of press rolls 10 to decompose the foam and to absorb the resulting treating solution in the cloth. Since the cloth is porous, wettable and hygroscopic, the foam is decomposed easily leaving the treating solution in the cloth in an absorbed state.

As explained above, in the present invention, a necessary and sufficient amount of a treating solution for the subsequent heat treatment can uniformly and surely be applied all over a cloth to be treated running continuously by sparing heat energy. The cloth can directly be subjected to a heat treatment in the subsequent step with no need of squeezing and intermediate drying for removing the excess of the treating solution and/or solvent. Since the foam is supplied into the foam tank at the bottom thereof with the aid of air, the foam floats up through the foam tank freely and smoothly with no danger of condensation into the liquid state. Furthermore, since the cloth is transported along a long path through the foam tank, the cloth is in contact with the foam for a long time, and accordingly the present inventive apparatus has a merit that the adhesion of the foam to the cloth is ensured.

What is claimed is:

1. An apparatus for continuously applying a treating solution as foam to a cloth, comprising a U-shaped foam tank for storing foam of a treating solution such as a dye solution, said U-shaped foam tank having a pair of upwardly extending legs and connected at the bottom of a bight section, an apparatus for generating foam of the treating solution connected to the bight section of said U-shaped foam tank, guide rolls for transporting a cloth to be treated continuously through the foam tank first downwardly through one of said legs and then upwardly through the other one of said legs so as to adhere the foam of the treating solution to the cloth while the cloth is passing therethrough, and a means for controlling the amount of foam adhered to the cloth in removing the cloth from the foam tank.

2. An apparatus for continuously applying a treating solution to a cloth as foam, as set forth in claim 1, including a cloth inlet at the upper end of one leg of said U-shaped foam tank and a cloth outlet at the upper end of the other leg, and said means for controlling the amount of foam adhered to the cloth in taking out the cloth from the foam tank comprises a narrow opening forming the cloth outlet from the foam tank.

3. An apparatus for continuously applying a treating solution to a cloth as foam, as set forth in claim 1, including a cloth inlet at the upper end of one leg of said U-shaped foam tank and a cloth outlet at the upper end of the other leg, and said means for controlling the amount of foam adhered to the cloth in taking out the cloth from the foam tank comprises a pair of cover plates forming said cloth outlet and said cover plates being slidable on both sides of said cloth outlet toward and away from one another.

* * * * *